US009986790B2

(12) United States Patent
Ness et al.

(10) Patent No.: US 9,986,790 B2
(45) Date of Patent: Jun. 5, 2018

(54) BUCKLE FOR EXERCISE STRAP

(71) Applicant: THE PROPHET CORPORATION, Owatonna, MN (US)

(72) Inventors: Jason J. Ness, Victoria, MN (US); Caleb Summers, St. Louis Park, MN (US); Matthew Allen Nelson, Minneapolis, MN (US); Amber L. Orenstein, Prior Lake, MN (US)

(73) Assignee: THE PROPHET CORPORATION, Owatonna, MN (US)

( * ) Notice: Subject to any disclaimer, the term of this patent is extended or adjusted under 35 U.S.C. 154(b) by 0 days. days.

(21) Appl. No.: 14/954,410

(22) Filed: Nov. 30, 2015

(65) Prior Publication Data

US 2017/0150786 A1 Jun. 1, 2017

(51) Int. Cl.

| | |
|---|---|
| ***A44B 11/00*** | (2006.01) |
| ***A44B 11/18*** | (2006.01) |
| ***A63B 21/04*** | (2006.01) |
| ***A63B 21/055*** | (2006.01) |
| ***A63B 21/00*** | (2006.01) |
| ***A63B 23/12*** | (2006.01) |
| ***A63B 23/04*** | (2006.01) |

(52) U.S. Cl.

CPC ..... *A44B 11/18* (2013.01); *A63B 21/00181* (2013.01); *A63B 21/0442* (2013.01); *A63B 21/0552* (2013.01); *A63B 21/4009* (2015.10); *A63B 21/4034* (2015.10); *A63B 23/0405* (2013.01); *A63B 23/1218* (2013.01); *A63B 23/1236* (2013.01)

(58) Field of Classification Search

CPC ..... Y10T 24/4755; Y10T 24/4764; Y10T 24/3416; Y10T 24/4056; Y10T 24/4012; A63B 23/1218; A63B 21/4009; A63B 21/4034; A63B 21/00181; A63B 21/0442; A63B 21/0552; A63B 23/1236; A63B 23/0405

See application file for complete search history.

(56) References Cited

U.S. PATENT DOCUMENTS 477,056 A * 6/1892 Kirkpatrick ..... A41F 9/002 24/182
686,934 A * 11/1901 Clark ..... A44B 11/06 24/168
1,697,833 A * 1/1929 Lane ..... B68B 5/00 24/170
2,057,575 A * 10/1936 Houghton ..... A44B 11/18 24/196

(Continued)

OTHER PUBLICATIONS

Chinning Bars PullUp Assistant Set—SportsKids Superstore http://www.sportskids.com/superstore/Fitness/Exercise+Equipment/Chinning+Bars/g_41878/?itemunavailable=Y 4 Pages (retrieved Oct. 8, 2015).

(Continued)

*Primary Examiner* — Jason W San
(74) *Attorney, Agent, or Firm* — Merchant & Gould P.C.

(57) ABSTRACT

Buckles for use in exercise assemblies employing force restorative exercise straps. A looped component and a hooked component of the buckle hold the exercise strap. The looped component and the hooked component can be pivotally mounted to each other. The buckle can hold the strap in two orientations, on an end of a looped strap, or at an adjustable position of the looped strap.

12 Claims, 7 Drawing Sheets

(56) References Cited

U.S. PATENT DOCUMENTS 2,267,180 A * 12/1941 White ..... A44B 11/06 24/191
2,268,738 A 1/1942 Chenette
2,563,809 A * 8/1951 Ash ..... A44B 11/06 24/197
2,643,431 A 6/1953 Schwarz
2,807,852 A * 10/1957 Rave ..... A44B 11/2588 24/197
2,853,757 A * 9/1958 Rave ..... A44B 11/18 24/197
2,889,599 A 6/1959 Perry et al.
2,901,801 A * 9/1959 Girodet ..... A41F 1/00 24/200
3,121,270 A * 2/1964 Den Broek Van ..... B65D 63/16 24/197
3,161,931 A 12/1964 Zif
3,175,862 A * 3/1965 Robbins ..... B60R 22/00 24/198
3,222,745 A 12/1965 Palmleaf et al.
3,277,543 A * 10/1966 Gaylord ..... A44B 11/18 24/193
3,407,452 A * 10/1968 Abert ..... A44B 11/18 24/197
3,663,995 A 5/1972 Somann
3,672,007 A * 6/1972 Steinberg ..... A44B 11/12 24/196
3,813,734 A * 6/1974 Schauweker ..... A44B 11/02 24/200
3,999,254 A * 12/1976 McLennan ..... A44B 11/10 24/196
4,175,304 A * 11/1979 Bentley ..... A44B 11/18 24/197
4,299,014 A * 11/1981 Wood ..... A44B 11/18 24/196
4,414,713 A * 11/1983 Prete, Jr. ..... A44B 11/125 24/193
4,417,372 A * 11/1983 Ronci ..... A43C 11/1413 24/163 R
4,470,176 A * 9/1984 Vermeulen ..... A44B 11/00 24/163 R
4,670,945 A * 6/1987 Banks ..... A44B 11/18 24/170
4,932,104 A * 6/1990 Kowal ..... A44B 11/28 241/170
5,205,021 A * 4/1993 Durand ..... A44B 11/12 24/163 R
5,426,829 A * 6/1995 Hsiung ..... A44B 11/02 24/16 R
5,432,984 A * 7/1995 Petzl ..... A44B 11/18 24/170
5,432,985 A * 7/1995 Bernart ..... A44B 11/04 24/200
5,438,734 A * 8/1995 Anderson ..... A44B 11/18 24/170
5,915,535 A * 6/1999 Henrekin-Jordan .... A41F 9/002 2/171
6,023,820 A * 2/2000 Fair ..... A44B 11/28 24/312
6,085,449 A * 7/2000 Tsui ..... A45C 13/42 2/67
6,539,592 B1 * 4/2003 Choi ..... A44B 11/18 2/195.2
6,802,109 B2 * 10/2004 Hede ..... A44B 11/28 24/165
7,051,407 B2 * 5/2006 Hsu ..... A41F 15/002 2/323
7,299,527 B1 * 11/2007 Gyure ..... A44B 11/006 24/198
7,665,248 B2 * 2/2010 Blackford ..... E04D 13/12 248/237
8,056,191 B2 * 11/2011 Crye ..... A44B 11/10 24/168
8,381,366 B2 * 2/2013 Hede ..... A44B 11/18 24/168
8,696,527 B2 * 4/2014 Wu ..... A63B 21/068 482/131
D713,293 S * 9/2014 Gurule ..... D11/212
8,840,532 B2 * 9/2014 Hetrick ..... A44B 11/2557 482/126
D721,010 S * 1/2015 Spater ..... D11/218
9,186,536 B2 * 11/2015 Strachan ..... A63B 21/0557
9,375,055 B2 * 6/2016 Tedder ..... A41F 15/002
9,491,990 B1 * 11/2016 Sadeck ..... A44B 11/00
2008/0078070 A1 * 4/2008 Weiss ..... A44B 11/04 24/318
2012/0329620 A1 * 12/2012 White ..... A63B 21/151 482/131
2013/0217547 A1 * 8/2013 Hinds ..... A63B 7/00 482/96
2014/0342884 A1 * 11/2014 Aldridge ..... A61H 1/0237 482/131
2017/0028244 A1 * 2/2017 Schreiber ..... A63B 21/0557
2017/0050071 A1 * 2/2017 Demarco ..... A63B 21/0552

OTHER PUBLICATIONS

Pull Up Bands http://pullupbands.net/pullupbands/lifelinepullupbands 5 Pages (retrieved Oct. 8, 2015).
Perfect Fitness Perfect PullUp Bar https://www.google.com/shopping/product/3805619717780411092?q=pull%C2%ADup+assist&rlz=1C1JPGB_enUS607US607&es_sm=93&biw=1366&bih=667&bav=on.%E2%80%A6 2 Pages (retrieved Oct. 8, 2015).
Pull Up Assist Bands http://pullupbands.net/pull%ADup%ADbands/pull%ADup%ADassist%ADbands1/3 3 Pages (retrieved Oct. 8, 2015).

* cited by examiner

BUCKLE FOR EXERCISE STRAP

BACKGROUND

Flexible, resilient straps that provide restorative force to counteract body weight and/or muscle resistance can be used to assist people with muscular resistance training. Coupling such straps to a stationary support structure can also assist (i.e., reduce the amount of effort required) with certain kinds of training, such as push-ups, pull-ups and leg dips. There is a need to improve the coupling between an exercise strap and a support structure and/or person.

SUMMARY

In general terms, this disclosure is directed to buckles for exercise straps, and buckle and exercise strap systems that are user friendly and provide secure coupling between the buckles and the exercise straps during exercises.

In one aspect, a buckle for an exercise strap comprises a looped component comprising an outer face, an inner face, a body, an aperture disposed in the body, and a shoulder abutting the aperture, the shoulder defining a first recess on the inner face of the looped component; and a hooked component pivotally coupled to the looped component and comprising an outer face, an inner face, a body, and a hooked portion, the hooked portion at least partially nesting in the first recess when the looped component and the hooked component are pivoted towards each other.

In another aspect, a system comprises at least one buckle, the at least one buckle comprising a looped component comprising an outer face, an inner face, a body, an aperture disposed in the body, and a shoulder abutting the aperture, the shoulder defining a first recess on the inner face of the looped component; and a hooked component pivotally coupled to the looped component and comprising an outer face, an inner face, a body, and a hooked portion, the hooked portion at least partially nesting in the first recess when the looped component and the hooked component are pivoted towards each other; and an exercise strap configured to provide restorative force when stretched, the exercise strap being coupled to the at least one buckle.

In a further aspect, a buckle for an exercise strap comprises: a looped component comprising an outer face, an inner face, a body, and an aperture disposed in the body; and a hooked component pivotally coupled to the looped component and comprising an outer face, an inner face, a body, and a hooked portion, the inner face of the hooked component being pivotal towards the inner face of the looped component in order that the exercise strap simultaneously contacts both the inner face of the looped component and the inner face of the hooked component.

In still a further aspect, a system comprises: a first buckle and a second buckle, each of the first buckle and the second buckle comprising: a looped component comprising an outer face, an inner face, a body, an aperture disposed in the body, and a shoulder abutting the aperture, the shoulder defining a recess on the inner face of the looped component; and a hooked component pivotally coupled to the looped component and comprising an outer face, an inner face, a body, and a hooked portion, the hooked portion at least partially nesting in the recess when the looped component and the hooked component are pivoted towards each other; and a loop shaped exercise strap configured to provide restorative force when stretched, wherein a first portion of the exercise strap passes through the aperture from the outer face of the looped component of a first of the two buckles and loops around the hooked portion of the hooked component of the first of the two buckles; and wherein a second portion of the exercise strap passes through the aperture from the outer face of the looped component of the second of the two buckles, loops around the hooked portion of the hooked component of the second of the two buckles, and passes through the aperture from the inner face of the looped component of the second of the two buckles between the shoulder of the second buckle and the hooked portion of the second buckle.

DETAILED DESCRIPTION

Figure 1:
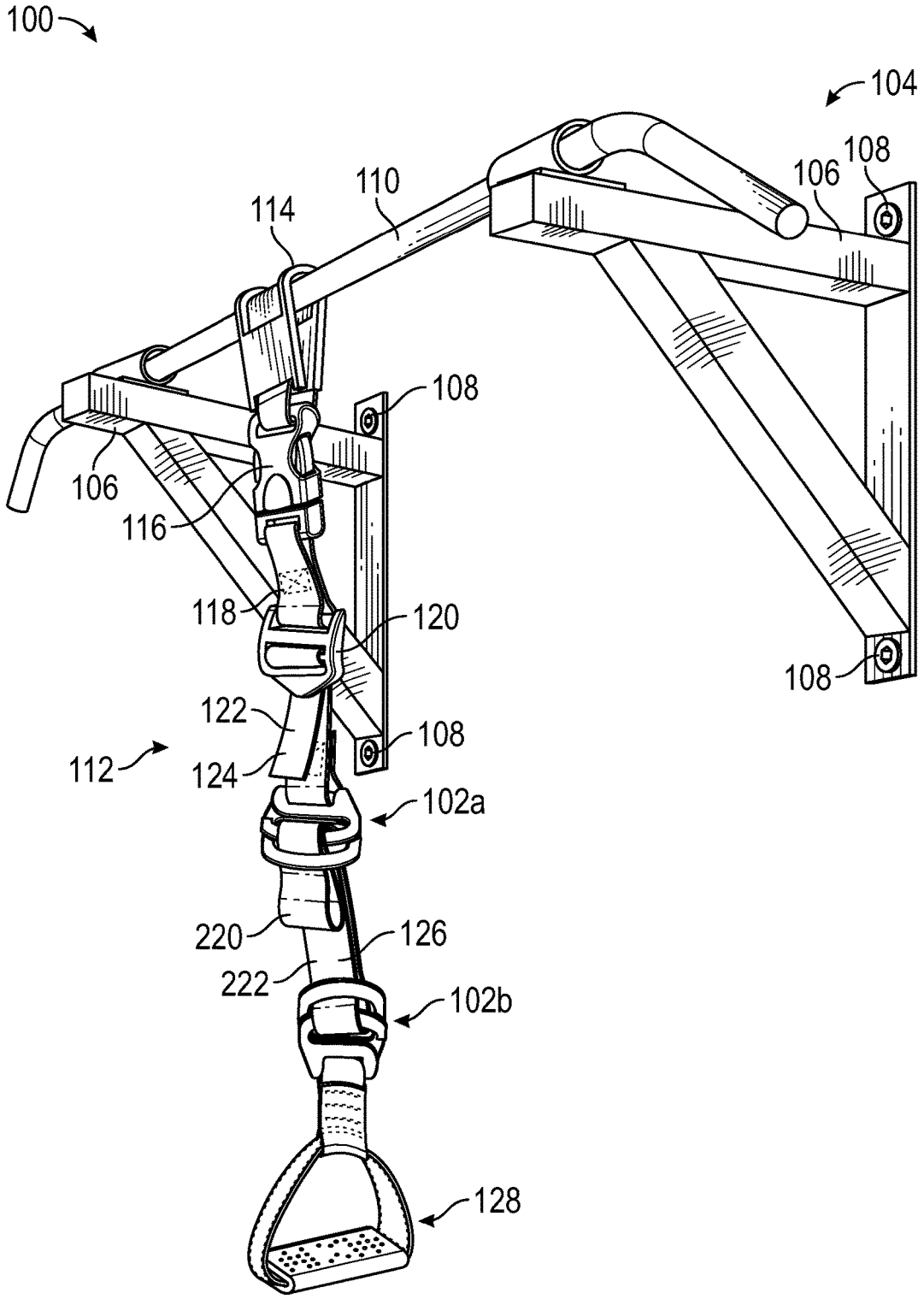
FIG. 1 is a perspective view of a first embodiment of an exercise assist assembly using example buckles in accordance with the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of a first embodiment of an exercise assist assembly 100 using example buckles 102*a* and 102*b* in accordance with the present disclosure. In this example, the buckles 102*a* and 102*b* are identical. The assembly 100 includes a support structure 104 having first and second brackets 106 mounted to an object (e.g., a wall) with a mounting means, e.g., the bolts 108. A support 110 (e.g., a bar) is coupled to the brackets 106. An assist device 112 is coupled to the support 110. The assist device 112 includes a suspension loop 114 that curls around at least a portion of the support 110, and from which the rest of the assist device 112 is suspended by gravity. In some examples, the support structure 104 is mounted to a stationary object, e.g., a wall.

An openable and closable clip 116 (e.g., a male-female frictional interference clip) removably couples the suspension loop 114 to the rest of the assist device 112. A substantially inflexible strap segment 118 (e.g., constructed of a woven nylon), is coupled on one end to the clip 116 and on an opposing end to the strap length adjuster 120. An adjustable and substantially inflexible strap 122 (e.g., constructed of a woven nylon) is fed through the strap length adjuster 120 such that a tail portion 124 of the strap 122 can be fed further through the strap length adjuster 120 to selectively shorten or lengthen the strap 122. The strap 122 is also coupled to the buckle 102*a*, which will be described in greater detail below.

An exercise strap 126 is adjustably coupled between the identical buckles 102*a* and 102*b*. In this example, the exercise strap 126 is a closed loop (i.e., it does not have a free end). It should be appreciated, however, that non-closed loop exercise straps can alternatively be used with the buckle (102*a*, 102*b*) of the present disclosure without departing from the operating principles thereof. The exercise strap 126 is made of an elastic, strong and resilient material that provides restorative force when stretched, i.e., a force that biases the strap towards its unstretched position from its stretched position. The exercise strap 126 is sufficiently elastic to stretch upon application of a person's weight or muscle force.

A stirrup 128 is coupled to the buckle 102*b* and suspends from the support 110 at the bottom of the assist device 112. In alternative examples, two more stirrups or other person-engaging components can be suspended from the exercise strap 126.

In one non-exhaustive example operation of the assembly 100, a user places one or both feet in the stirrup 128 and grips the support 110 with one or both hands. The weight of the user tends to stretch the exercise strap 126. Stretching of the exercise strap 126 generates a restorative force that biases the person's weight carried by the stirrup 128 against the force of gravity and towards the support 110, thereby reducing the effort required by the user to perform one or more pull-ups, chin-ups, or the like, on the support 110.

Figure 2:
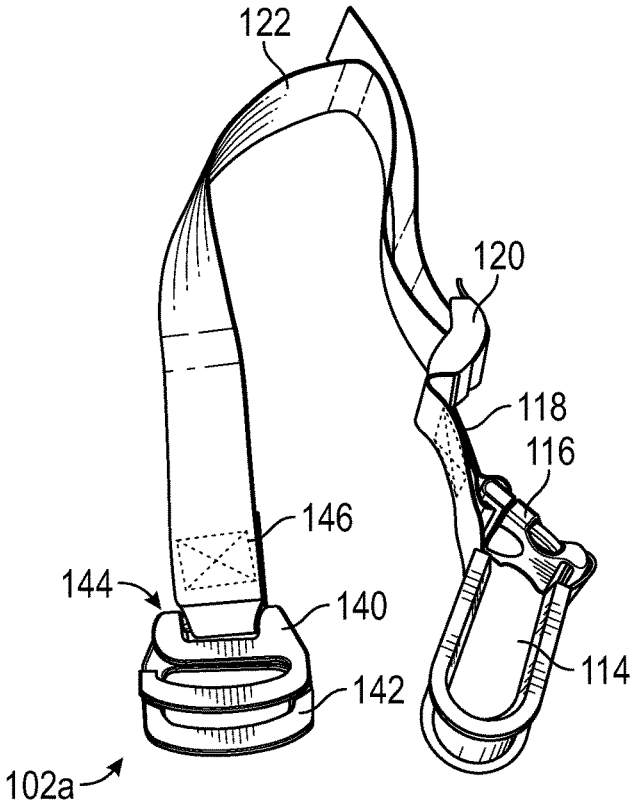
FIG. 2 is a perspective view of a first portion of the assembly of FIG. 1.
Figure 3:
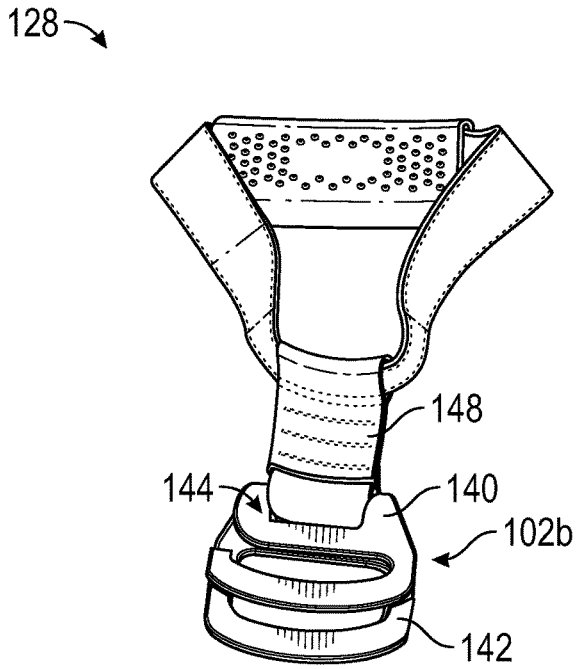
FIG. 3 is a perspective view of a second portion of the assembly of FIG. 1.

FIG. 2 is a perspective view of a first portion of the assembly of FIG. 1, including the buckle 102*a*, the suspension loop 114, the clip 116, the strap segment 118, the strap length adjuster 120 and the substantially inflexible strap 122 as discussed above. FIG. 3 is a perspective view of a second portion of the assembly of FIG. 1, including the buckle 102*b* and the stirrup 128.

With reference to FIGS. 2 and 3, each of the buckles 102*a* and 102*b* includes a hooked component 140 and a looped component 142. At least one of the hooked component 140 and the looped component 142 (in this example, both the hooked component 140 and the looped component 142) includes a slotted region 144.

With reference to FIG. 2, in this example one end of the substantially inflexible strap 122 is secured to the slotted region 144 of the buckle 102*a*, e.g., by feeding the end of the strap 122 through the slotted region 144 of the buckle 102*a* and affixing (permanently or detachably) the end of the strap 122 to another portion of the strap 122 (e.g., with stitching 146), thereby looping the strap 122 through the slotted region 144 of the buckle 102*a*.

With reference to FIG. 3, in this example, a band 148 is coupled to the stirrup 128 on one end, and looped through the slotted region 144 of the buckle 102*b* on an opposing end, thereby securely affixing the stirrup 128 to the buckle 102*b*.

Figure 4:
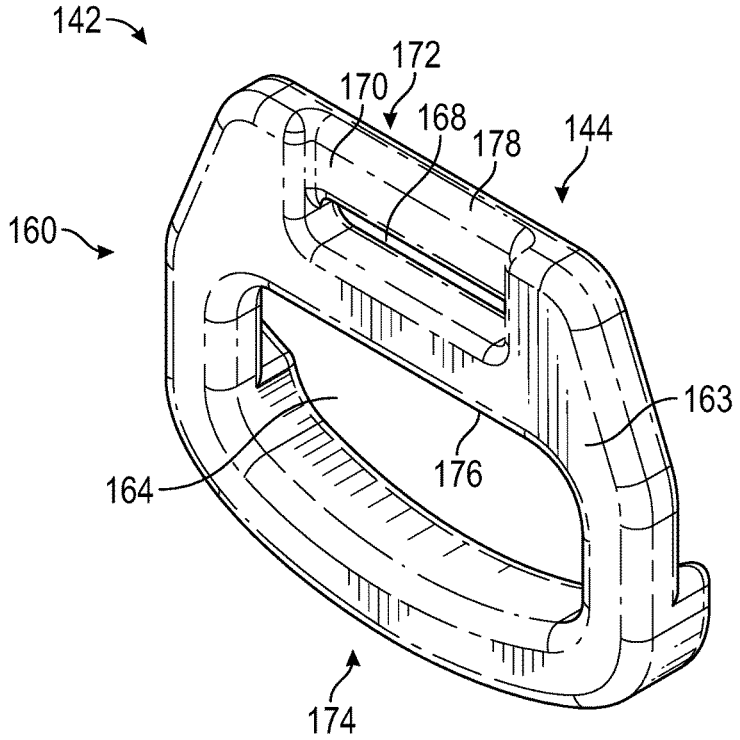
FIG. 4 is a perspective view of the looped component of the buckle of FIGS. 2-3.
Figure 5:
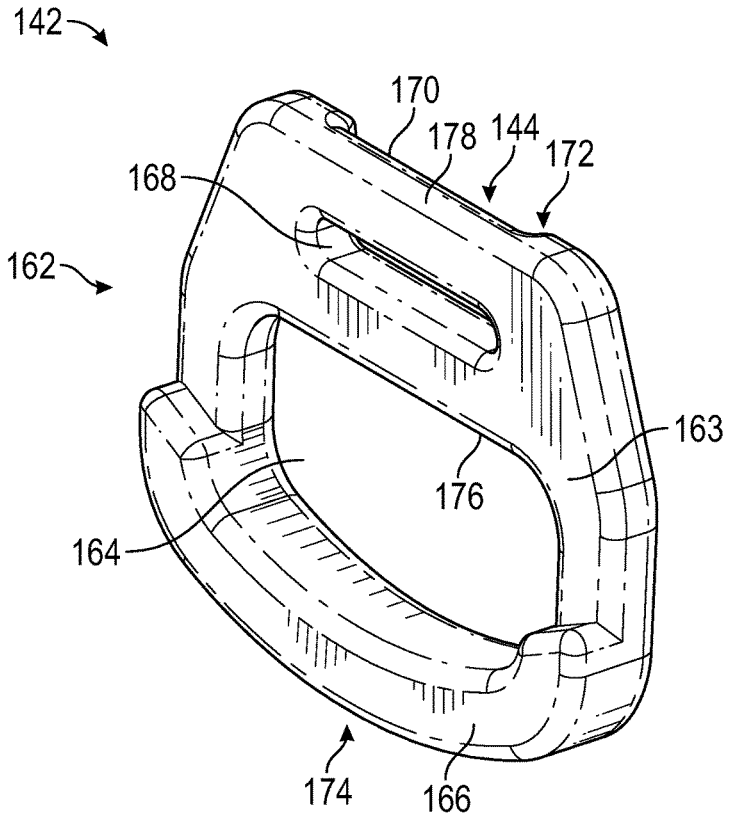
FIG. 5 is a further perspective view of the looped component of the buckle of FIGS. 2-3.

FIG. 4 is a perspective view of the looped component 142 of the buckle (102*a*, 102*b*) of FIGS. 2-3. FIG. 5 is a further perspective view of the looped component 142 of the buckle (102*a*, 102*b*) of FIGS. 2-3.

With reference to FIGS. 4-5, the looped component 142 includes the slotted region 144 discussed above. In addition, in this example, the looped component 142 includes an outer face 160, an inner face 162, a body 163, an aperture 164, a shoulder 166, a slot 168 and a recess 170. The slotted region 144 is disposed towards a first end 172 of the looped component 142; and the shoulder 166 is disposed towards a second end 174 of the looped component 142, the second end 174 opposing the first end 172.

In operation of the buckle (102*a*, 102*b*) (FIG. 1), the outer face 160 faces away from the hooked component 140 (FIGS. 2-3), while the inner face 162 faces towards the hooked component 140 (FIGS. 2-3). The aperture 164 is open at both the outer face 160 and the inner face 162 (i.e., the aperture 164 is accessible via both the outer face 160 and the inner face 162). The aperture 164 is disposed in the body 163 between the shoulder 166 and the slotted region 144, the shoulder abutting a portion of the perimeter 176 of the aperture 164.

The slot 168 is open at both the outer face 160 and the inner face 162 (i.e., the slot 168 is accessible via both the outer face 160 and the inner face 162). The slot 168 is disposed in the recess 170 and is configured to receive a strap or band (e.g., the strap 122 (FIG. 2) or the band 148 (FIG. 3)) therein which can be looped around the bar 178. Although optional, placement of the slot 168 in the recess 170 provides for a bar 178 that is thinner than adjacent portions of the body 163, such that a relatively shorter length of strap or band is required to loop around the bar 178 than would be required in the absence of the recess 170.

Figure 6:
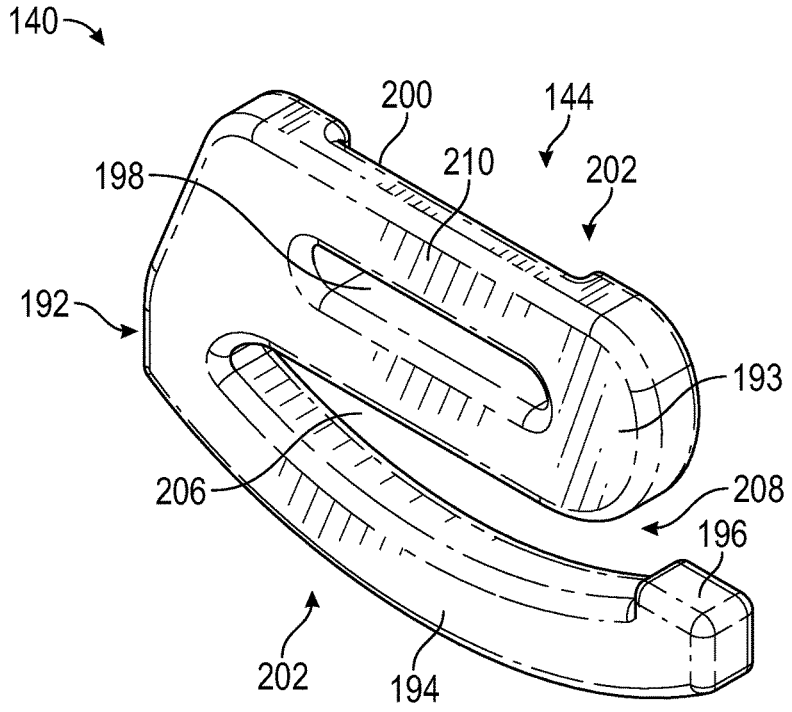
FIG. 6 is a perspective view of the hooked component of the buckle of FIGS. 2-3.
Figure 7:
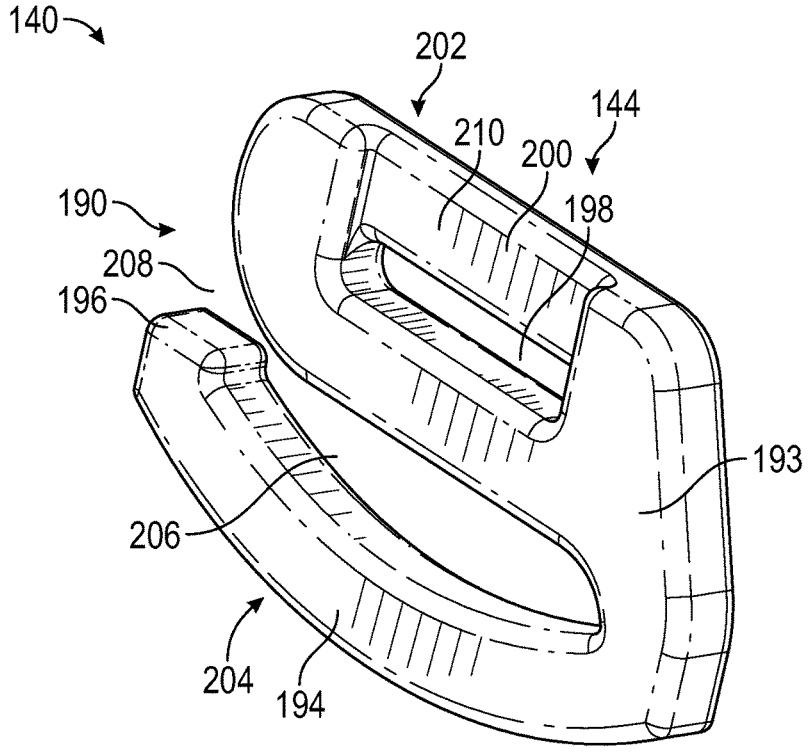
FIG. 7 is a further perspective view of the hooked component of the buckle of FIGS. 2-3.

FIG. 6 is a perspective view of the hooked component 140 of the buckle (102*a*, 102*b*) of FIGS. 2-3. FIG. 7 is a further perspective view of the hooked component 140 of the buckle (102*a*, 102*b*) of FIGS. 2-3.

With reference to FIGS. 6-7, the hooked component 140 includes the slotted region 144 discussed above. In addition, in this example, the hooked component 140 includes an outer face 190, an inner face 192, a body 193, a hooked portion 194, a hook extension 196, a slot 198 and a recess 200. The slotted region 144 is disposed towards a first end 202 of the hooked component 140; and the hooked portion 194 is disposed towards a second end 204 of the hooked component 140, the second end 204 opposing the first end 202. The hooked portion 194 defines a slit 206 accessible via the gap 208 between the hook extension 196 and the body 193. The slit 206 is also open to the outer face 190 and the inner face 192.

In operation of the buckle (102*a*, 102*b*) (FIG. 1), the outer face 190 faces away from the looped component 142 (FIGS. 2-3), while the inner face 192 faces towards the looped component 142 (FIGS. 2-3). Though alternative configurations (e.g., straight) can be substituted, in this example the hooked portion 194 is arcuate in shape, having a concavity that faces towards the first end 202 of the hooked component 140. The hook extension 196 projects from the free end of the hooked portion 194 towards the first end 202 of the hooked component 140 and can act as a stop that helps minimize undesired slippage of a strap or band through the gap 208 from the slit 206.

The slot 198 is open at both the outer face 190 and the inner face 192 (i.e., the slot 198 is accessible via both the outer face 190 and the inner face 192). The slot 198 is disposed in the recess 200 and is configured to receive a strap or band (e.g., the strap 122 (FIG. 2) or the band 148 (FIG. 3)) therein which can be looped around the bar 210. Although optional, placement of the slot 198 in the recess 200 provides for a bar 210 that is thinner than adjacent portions of the body 193, such that a relatively shorter length of strap or band is required to loop around the bar 210 than would be required in the absence of the recess 200.

Although the drawings show an embodiment of the buckle (102*a*, 102*b*) in which the hooked component 140 and the looped component 142 are discrete separable pieces, it should be appreciated that the buckle 102*a*, 102*b* can alternatively be constructed as single unit, with the hooked component 140 and the looped component 142 pivotally and permanently coupled to each other via, e.g., a hinge. The hooked component 140 and the looped component 142 are preferably molded or machined from a strong rigid material, such as a rigid plastic, a metal, wood, and so forth.

Figure 8:
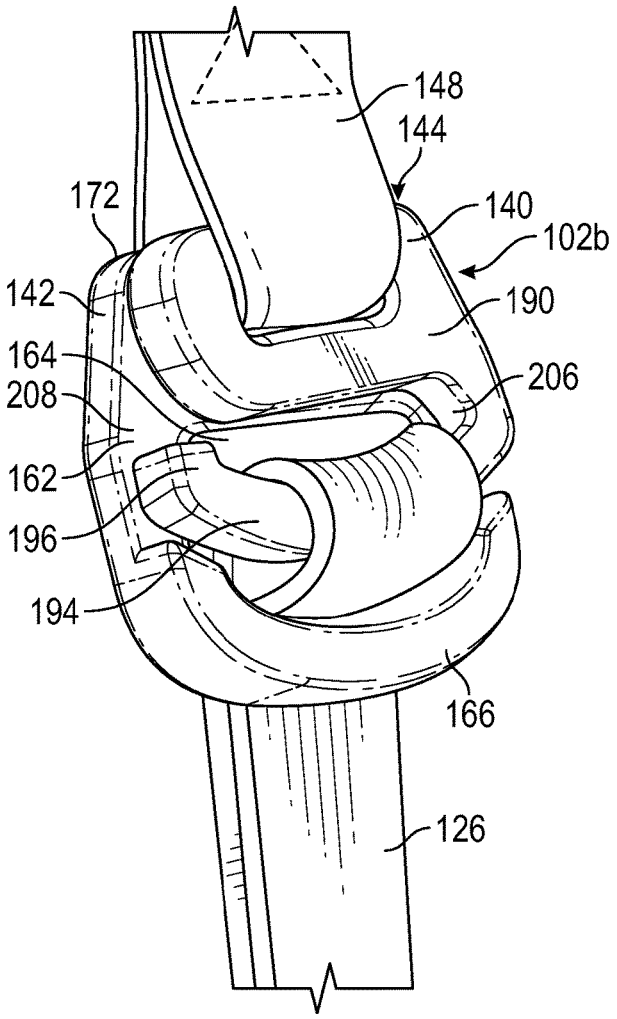
FIG. 8 is a perspective view of a third portion of the assembly of FIG. 1.
Figure 9:
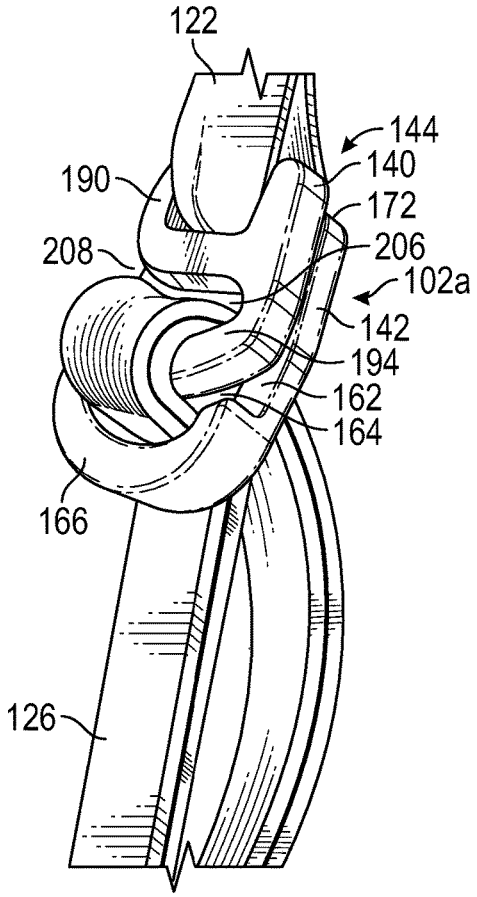
FIG. 9 is a perspective view of a fourth portion of the assembly of FIG. 1.

FIG. 8 is a perspective view of the buckle 102*b*, the band 148 and the exercise strap 126 of the assembly 100 of FIG. 1. FIG. 9 is a perspective view of the buckle 102*a*, the substantially inflexible strap 122 and the exercise strap 126 of the assembly 100 of FIG. 1.

With reference to FIGS. 8-9, the buckle (102*a*, 102*b*) includes the hooked component 140 having the outer face 190, the looped component 142 having the inner face 162, the aperture 164, the slit 206, the hooked portion 194, the hook extension 196, the gap 208, the shoulder 166 and the slotted region 144 as discussed above. The hooked component 140 at least partially nests within the looped component 142, in that the hooked portion 194 is disposed closer to the first end 172 of the looped component 142 than the shoulder 166, the hooked portion 194 being substantially within the recess of the inner face 162 that is defined by the shoulder 166.

With reference to FIG. 8, the exercise strap 126 is shown in a locked configuration with the buckle 102*b*. As discussed above in connection with FIG. 1, the example exercise strap 126 is a closed loop (i.e., it does not have a free end). To obtain the locked configuration, a portion of the exercise strap is fed through the aperture 164 of the looped component 142 from the outer face 160. The hooked component 140 is pivoted away from the inner face 162 of the looped component 142, and a single ply of the exercise strap 126 is inserted through the gap 208 and looped around the hooked portion 194 of the hooked component 140. With the exercise strap 126 looped around the hooked portion 194, pulling on the exercise strap 126 in a direction towards the buckle 102*a* (FIG. 1), as when using the assembly 100 of FIG. 1 to assist with exercise, has the effect of pivoting the hooked component 140 back towards its nested configuration with the looped component 142 such that the exercise strap 126 simultaneously is in contact with (and sandwiched between) the inner face 162 of the looped component 142 and the inner face 192 of the hooked component 140, effectively locking the exercise strap 126 with respect to the buckle 102*b* as a result of the friction generated between and amongst the body 163, the shoulder 166, the hooked portion 194 and the exercise strap 126.

With reference to FIG. 9, the exercise strap 126 is shown in an adjustable configuration with the buckle 102*a*. To obtain the adjustable configuration, a portion of the exercise strap 126 is fed, in a double ply fashion, through the aperture 164 of the looped component 142 from the outer face 160. The hooked component 140 is pivoted away from the inner face 162 of the looped component 142, and the double ply of the exercise strap 126 is inserted through the gap 208 and looped around the hooked portion 194 of the hooked component 140 and fed back through the aperture 164 from the inner face 162 between the shoulder 166 and the hooked portion 194, leaving a free end 220 (see FIG. 1) of the double ply portion of the exercise strap 126.

Still with reference to FIG. 9, with the double ply portion of the exercise strap 126 looped around the hooked portion 194, pulling on the exercise strap 126 in a direction towards the buckle 102*b* (FIG. 1), as when using the assembly 100 of FIG. 1 to assist with exercise, has the effect of pivoting the hooked component 140 back towards its nested configuration with the looped component 140 such that the exercise strap 126 simultaneously is in contact with (and sandwiched between) the inner face 162 of the looped component 142 and the inner face 192 of the hooked component 140, effectively locking the exercise strap 126 with respect to the buckle 102*a* as a result of the friction generated between and amongst the body 163, the shoulder 166, the hooked portion 194 and the exercise strap 126.

With reference to FIG. 1 and FIG. 9, the length of the portion 222 (FIG. 1) of the exercise strap 126 suspended between the buckles 102*a* and 102*b* can be adjusted by pivoting the hooked portion 194 of the buckle 102*a* away from the looped component 142 of the buckle 102*a* and pulling (to shorten the length of the portion 222) or pushing (to increase the length of the portion 222) the free end 220 of the exercise strap 126 through the space between the hooked portion 194 and the shoulder 166 of the buckle 102*a*. Adjusting the length of portion 222 of the exercise strap 126 suspended between the buckles 102*a* and 102*b* can shorten or lengthen the assist device 112 (e.g., for bigger or smaller users). In addition, adjusting the length of the suspended portion 222 of the exercise strap 126 can adjust the amount of restorative force provided by the exercise strap 126, thereby making the exercise more or less easy to perform, as desired by the user.

Figure 10:
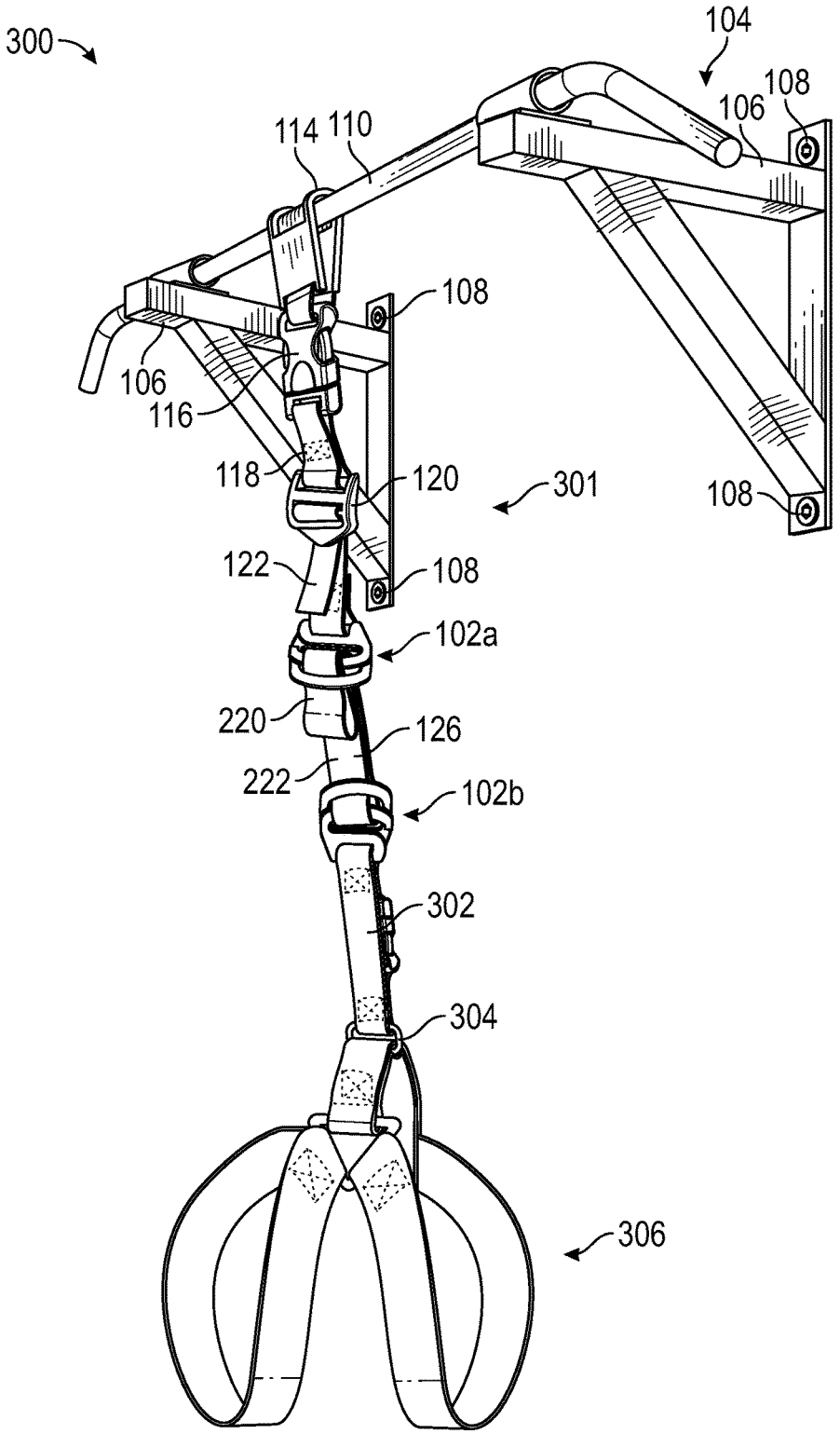
FIG. 10 is a perspective view of a second embodiment of an exercise assist assembly using the example buckles shown in FIG. 1.

FIG. 10 is a perspective view of a second embodiment of an exercise assist assembly 300 using example buckles 102*a* and 102*b* in accordance with the present disclosure. The assembly 300 includes the buckles 102*a* and 102*b*, the support structure 104, the brackets 106, the bolts 108, and the support 110, as discussed above. The assembly 300 also includes an assist device 301 having the suspension loop 114, the closable clip 116, the inflexible strap segment 118, the strap length adjuster 120, the substantially inflexible strap 122, and the exercise strap 126, as discussed above. In addition, in this example the assist device 301 includes a harness extension 302, a harness extension coupling ring 304 and a harness 306.

The harness extension 302 couples to the buckle 102*b* on one end, and to the harness 306 via the harness extension coupling ring 304 on the other end. In one non-axhaustive example operation of the assembly 300, a user places a portion of their body (e.g., their waste, torso) in the harness 306 and assumes a push-up position on the ground. The weight of the user tends to stretch the exercise strap 126. Stretching of the exercise strap 126 generates a restorative force that biases the person's weight carried by the harness 306 against the force of gravity and towards the support 110, thereby reducing the effort required by the user to perform one or more push-ups or the like.

Figure 11:
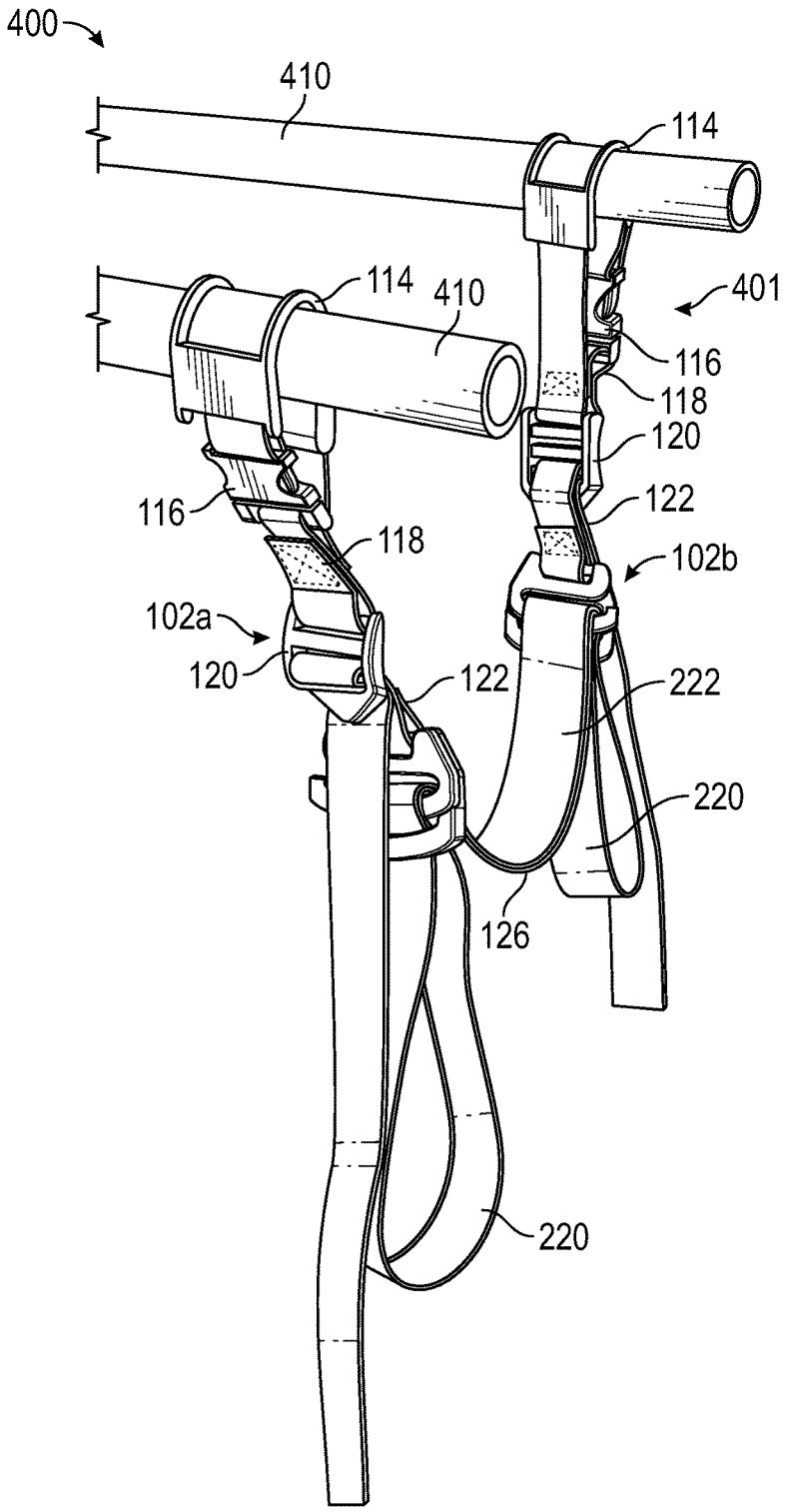
FIG. 11 is a perspective view of a third embodiment of an exercise assist assembly using the example buckles shown in FIG. 1.

FIG. 11 is a perspective view of a third embodiment of an exercise assist assembly 400 using example buckles 102*a* and 102*b* in accordance with the present disclosure. The assembly 400 includes the buckles 102*a* and 102*b* as discussed above, and an assist device 401 attached to a pair of supports 410. The assist device 401 suspends from the pair of supports 410 and includes a suspension loop 114, a closable clip 116, an inflexible strap segment 118, a strap length adjuster 120, and an inflexible strap 122, as described above, suspended from each of the supports 410. The buckles 102*a* and 102*b* are coupled to the pair of inflexible straps 122, respectively. An exercise strap 126, as described above, is coupled in the adjustable configuration (see discussion above in connection with FIG. 9) to each of the buckles 102*a* and 102*b*, such that there are two free ends 220, as discussed above, and a strap portion 222 (as discussed above) disposed between the two buckles 102*a* and 102*b*. By pushing or pulling the strap's free ends 220 through their respective buckles (102*a*, 102*b*) in the manner as described above in connection with FIG. 9, the strap portion 222 can be lengthened or shortened in accordance with the user's exercise desires.

In one non-exhaustive example operation of the assembly 400, a user places a portion of their leg (e.g., knee) in the seat created by the strap portion 222. As the user performs leg dips or another exercise, the weight of the user tends to stretch the exercise strap 126, which generates a restorative force that biases the person's weight carried by the exercise strap 126 against the force of gravity and towards the supports 410, thereby reducing the effort required by the user to perform one or more leg dips or the like.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A buckle for an exercise strap comprising:

a looped component comprising a first body having an outer face and an inner face, the first body defining an aperture enclosed by the first body and having a width and a length, the looped component further comprising a shoulder abutting the aperture along an entirety of the width of the aperture and abutting a portion of the aperture along the length of the aperture, the shoulder projecting inwardly from the inner face to an inward-most surface of the shoulder; and a hooked component pivotally coupled to the looped component and comprising a second body having a planar outer face and a planar inner face, and a hooked portion having an outer surface that is coplanar with the planar outer face of the second body and an inner surface that is coplanar with the planar inner face of the second body, the hooked portion extending from the second body to a free end of the hooked portion and defining an elongated slit between the second body and the hooked portion, at least a portion of the hooked portion being closer to the inner face of the first body than the inward-most surface of the shoulder when the looped component and the hooked component are pivoted towards each other;

wherein the hooked component comprises a gap between the free end of the hooked portion and the second body, the gap defining an open end of the elongated slit;

wherein the first body further comprises a slot disposed in a first recess;

wherein the second body further comprises a slot disposed in a second recess;

wherein the first recess is disposed on the outer face of the first body; and wherein the second recess is disposed on the outer face of the second body.

2. The buckle as in claim 1, wherein a strap passes through the slot in the first body and the slot in the second body, and wherein the hooked component and the looped component are pivotal relative to each other about the strap.

3. The buckle of claim 1, wherein the looped component and the hooked component are adapted to sandwich a strap between the shoulder and the hooked portion when the looped component and the hooked component are pivoted towards each other.

4. The buckle of claim 1, wherein the shoulder comprises a side substantially perpendicular to the inward-most surface, and wherein the side of the shoulder substantially faces a side of the hooked portion when the looped component and the hooked component are pivoted towards each other.

5. The buckle of claim 1, wherein the hooked portion covers a portion of the aperture when the looped component and the hooked component are pivoted together.

6. The buckle of claim 1, wherein the looped component has a first end and an opposing second end, wherein the shoulder is positioned at the second end, and wherein the hooked portion of the hooked component is closer than the shoulder to the first end of the looped component when the looped component and the hooked component are pivoted towards each other.

7. A buckle for an exercise strap comprising:

a looped component comprising a first body having an outer face and an inner face, the first body defining an aperture enclosed by the first body and having a width and a length, the looped component further comprising a shoulder abutting the aperture along an entirety of the width of the aperture and abutting a portion of the aperture along the length of the aperture, the shoulder projecting inwardly from the inner face to an inward-most surface of the shoulder; and a hooked component pivotally coupled to the looped component and comprising a second body having a planar outer face and a planar inner face, and a hooked portion having an outer surface that is coplanar with the planar outer face of the second body and an inner surface that is coplanar with the planar inner face of the second body, the hooked portion extending from the second body to a free end of the hooked portion and defining an elongated slit between the second body and the hooked portion, at least a portion of the hooked portion being closer to the inner face of the first body than the inward-most surface of the shoulder when the looped component and the hooked component are pivoted towards each other;

wherein the hooked component comprises a gap between the free end of the hooked portion and the second body, the gap defining an open end of the elongated slit;

wherein the first body further comprises an enclosed slot extending from the outer face to the inner face of the first body; and wherein the second body further comprises an enclosed slot extending from the outer face to the inner face of the second body.

8. The buckle as in claim 7, wherein a strap passes through the enclosed slot in the first body and the enclosed slot in the second body, and wherein the hooked component and the looped component are pivotal relative to each other about the strap.

9. The buckle of claim 7, wherein the looped component and the hooked component are adapted to sandwich a strap between the shoulder and the hooked portion when the looped component and the hooked component are pivoted towards each other.

10. The buckle of claim 7, wherein the shoulder comprises a side substantially perpendicular to the inward-most surface, and wherein the side of the shoulder substantially faces a side of the hooked portion when the looped component and the hooked component are pivoted towards each other.

11. The buckle of claim 7, wherein the hooked portion covers a portion of the aperture when the looped component and the hooked component are pivoted together.

12. The buckle of claim 7, wherein the looped component has a first end and an opposing second end, wherein the shoulder is positioned at the second end, and wherein the hooked portion of the hooked component is closer than the shoulder to the first end of the looped component when the looped component and the hooked component are pivoted towards each other.

* * * * *